US007617931B2

(12) United States Patent
Shiao

(10) Patent No.: US 7,617,931 B2
(45) Date of Patent: Nov. 17, 2009

(54) GOLF BAG STRUCTURE WITH TWO LEG ASSEMBLIES

(76) Inventor: Kun-Lin Shiao, No. 14, Shih 1st Rd., Youth Ind. Park, Yangmei Chen, Taoyuan Hsien (TW)

( * ) Notice: Subject to any disclaimer, the term of this patent is extended or adjusted under 35 U.S.C. 154(b) by 773 days.

(21) Appl. No.: 11/401,080

(22) Filed: Apr. 10, 2006

(65) Prior Publication Data

US 2007/0246384 A1 Oct. 25, 2007

(51) Int. Cl.
*A63B 55/00* (2006.01)

(52) U.S. Cl. ..... 206/315.7; 248/96

(58) Field of Classification Search ..... 206/315.7; 248/96

See application file for complete search history.

(56) References Cited

U.S. PATENT DOCUMENTS 1,715,668 A * 6/1929 Mooney ..... 224/615
5,474,176 A * 12/1995 Schenkkan ..... 206/315.7
6,652,045 B1 * 11/2003 Jungkind ..... 206/315.7
7,494,009 B2 * 2/2009 Shiao ..... 206/315.7

* cited by examiner

*Primary Examiner*—Tri M Mai
(74) *Attorney, Agent, or Firm*—Alan Kamrath; Kamrath & Associates PA

(57) ABSTRACT

A golf bag structure has a base, a post, a top frame, two leg assemblies and a cord. The base has a pivot bracket attached pivotally to the base and a cord guide. The post is attached to the pivot bracket. The top frame is attached to the post and has a divider and a cord passage defined through the divider. The leg assemblies are attached to the top frame, and each leg assembly has a pivot mount and a leg. The pivot mount is attached pivotally to the top frame. The leg is attached to the pivot mount. The cord extends through the cord guide and the cord passage in the top frame and is connected to the base and the pivot mounts of the leg assemblies. The leg assemblies keep articles such as golf clubs in the golf bag from falling out.

10 Claims, 6 Drawing Sheets

GOLF BAG STRUCTURE WITH TWO LEG ASSEMBLIES

BACKGROUND OF THE INVENTION

1. Field of the Invention

The present invention relates to a golf bag structure, and more particularly to a golf bag structure with two leg assemblies that can stand stably on the ground.

2. Description of Related Art

Golf bags are used to hold golf clubs. A conventional golf bag is cylindrical and has a flat bottom so that the golf bag can stand upright on the ground. However, grassy surfaces of most golf courses are not flat. A golf bag standing on the grass may easily fall over.

A conventional golf bag, called stand bag, comprises a bag body, two legs, a supporting foot and two activating flexible rods. The bag body has an open top, a bottom and a sidewall. The legs are attached pivotally to the sidewall of the bag body close to the top, and each leg has a proximal end. The supporting foot is mounted pivotally on the bottom of the bag body and has a bottom that contacts the ground when the golf bag stands on the ground. The activating rods are connected pivotally to the supporting foot, and each activating rod has a distal end. The distal ends of the activating rods are pivotally attached respectively to the legs near the proximal ends of the legs. Inclining the bag body relative to the supporting foot causes the activating rods to pivot the legs away from the bag body so that the golf bag can stand obliquely and stably on the ground.

However, the activating rods are made with metal and therefore are heavy, are exposed and are damaged or broken easily in the course of normal use.

To overcome the shortcomings, the present invention provides a golf bag structure with two leg assemblies to mitigate or obviate the aforementioned problems.

SUMMARY OF THE INVENTION

The main objective of the invention is to provide a golf bag structure with two leg assemblies that is lightweight, has a simple operation and can stand stably anywhere on a golf course.

A golf bag structure in accordance with the present invention and an outer covering form a golf bag, and the golf bag structure comprises a base, a post, a top frame, two leg assemblies and a cord.

The base has a pivot bracket and a cord guide with a through hole. The pivot bracket is attached pivotally to the base.

The post is attached to the pivot bracket.

The top frame is attached to the post and has a divider and a passage defined through the divider.

The leg assemblies are attached to the top frame, and each leg assembly has a pivot mount and a leg. The pivot mount is attached pivotally to the top frame. The leg is attached to the pivot mount.

The cord extends through the through hole in the cord guide and the passage in the top frame and is connected to the base and the pivot mounts of the leg assemblies.

Other objectives, advantages and novel features of the invention will become more apparent from the following detailed description when taken in conjunction with the accompanying drawings.

DETAILED DESCRIPTION OF PREFERRED EMBODIMENT

Figure 1:
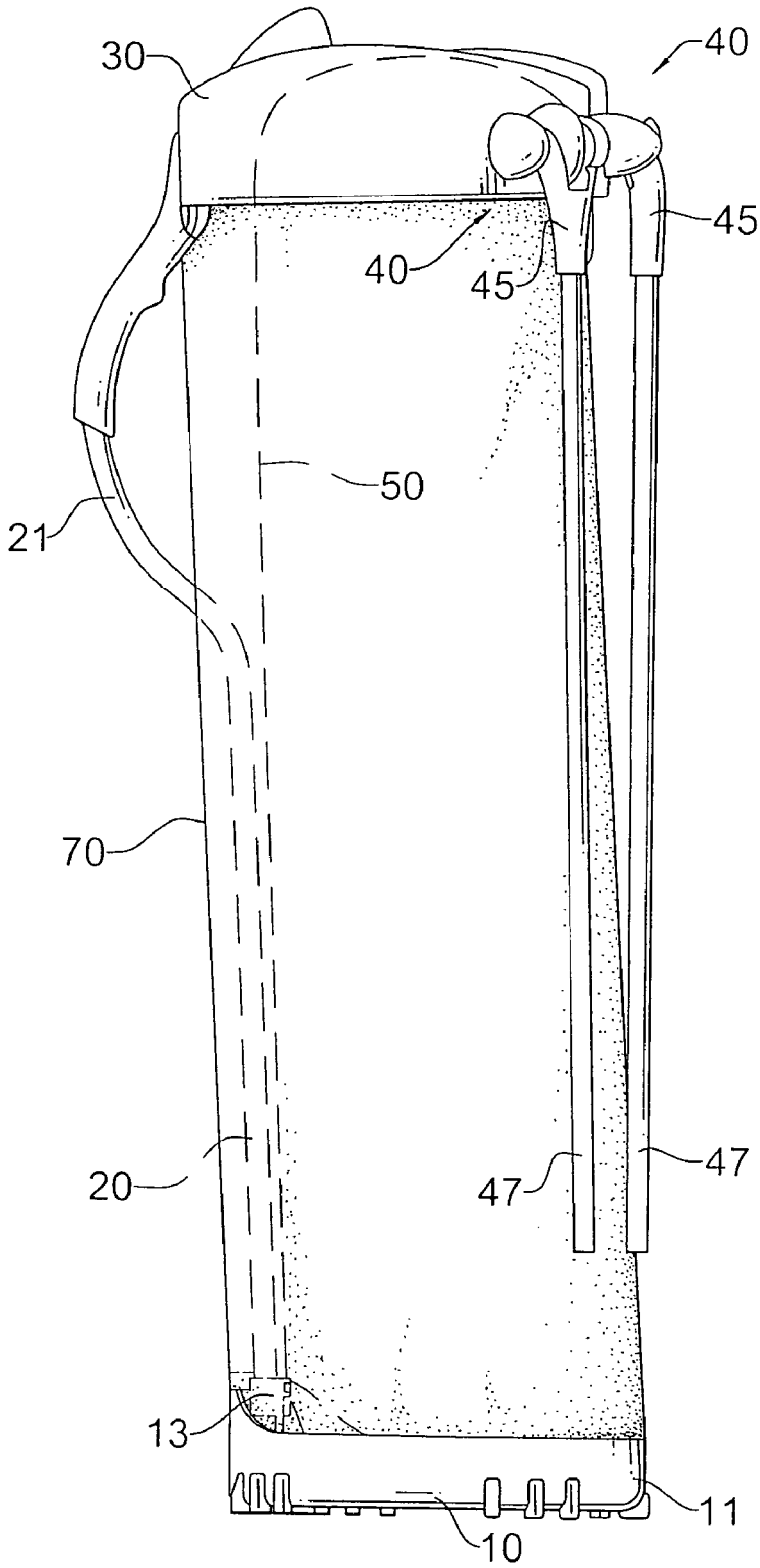
FIG. 1 is a side view of a golf bag structure in accordance with the present invention with an outer covering.

With reference to FIG. 1, a golf bag structure in accordance with present invention is used with an outer covering (70) to form a golf bag. The outer covering (70) is cloth, leather or another flexible and is mounted around the golf bag structure to form a golf bag.

The golf bag structure comprises a base (10), a post (20), a top frame (30), two leg assemblies (40) and a cord (50).

Figure 3:
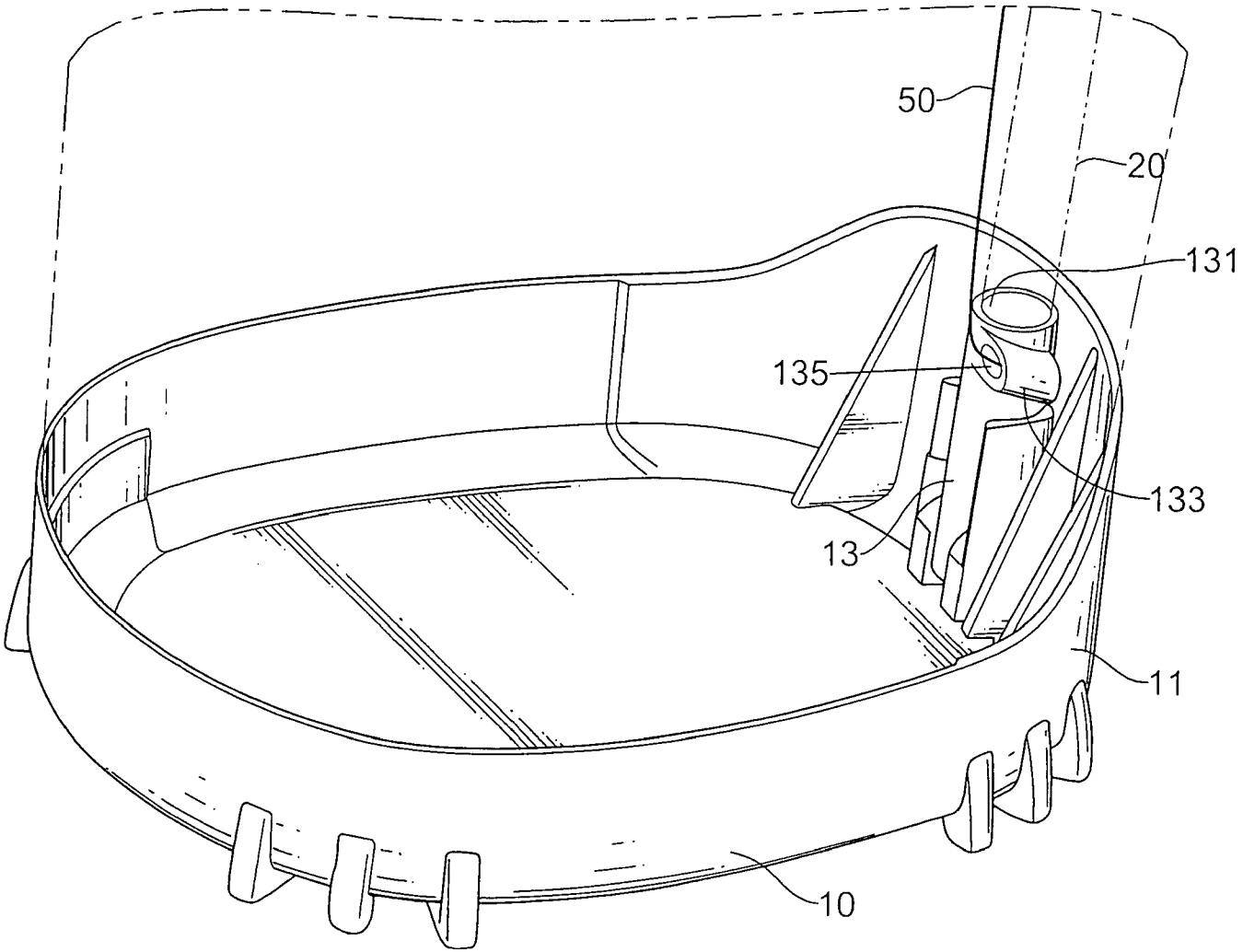
FIG. 3 is an enlarged perspective view of the base of the golf bag structure in FIG. 1.
Figure 4:
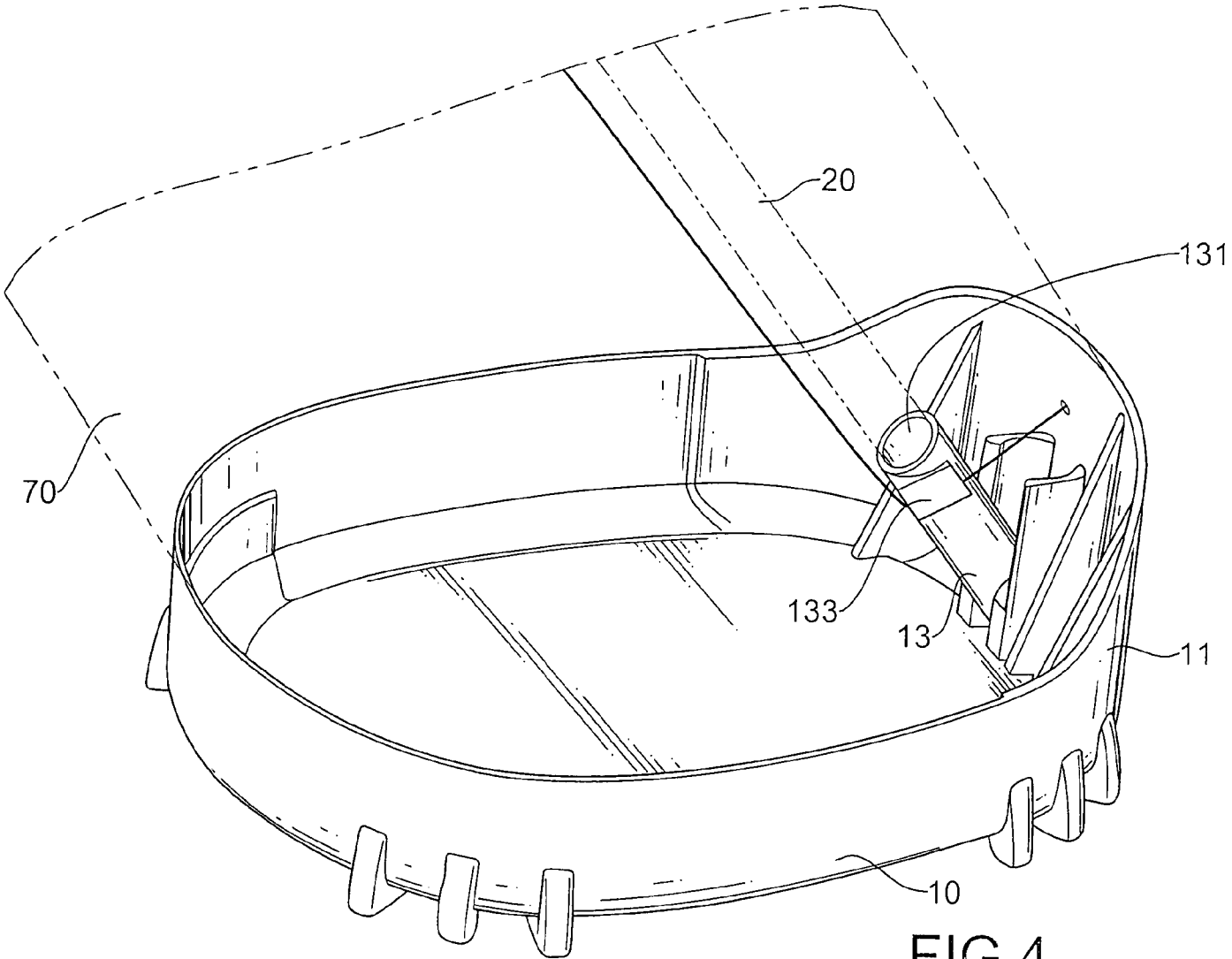
FIG. 4 is an operational enlarged perspective view of the base of the golf bag in FIG. 2 with the pivot bracket pivoted.

With further reference FIGS. 3 and 4, the base (10) may be put on the ground and has a top surface, an annular sidewall (11) and a pivot bracket (13). The annular sidewall (11) extends up from the base (10) and has an inner surface. The pivot bracket (13) is mounted pivotally on the top surface of the base (10) adjacent to the inner surface of the annular sidewall (11), allows the base (10) to stay parallel to the ground and has a distal end, a mounting hole (131) and a cord guide (133). The mounting hole (131) is defined in the distal end of the pivot bracket (13). The cord guide (133) is formed on the pivot bracket (13) and has a through hole (135) defined through the cord guide (133).

The post (20) is attached to and extends up from the pivot bracket (13) and has a top end, a bottom end and a curved handle (21). The bottom end of the post (20) is mounted in the mounting hole (131) in the pivot bracket (13). The curved handle (21) is a section of the post (20) near the top end.

Figure 2:
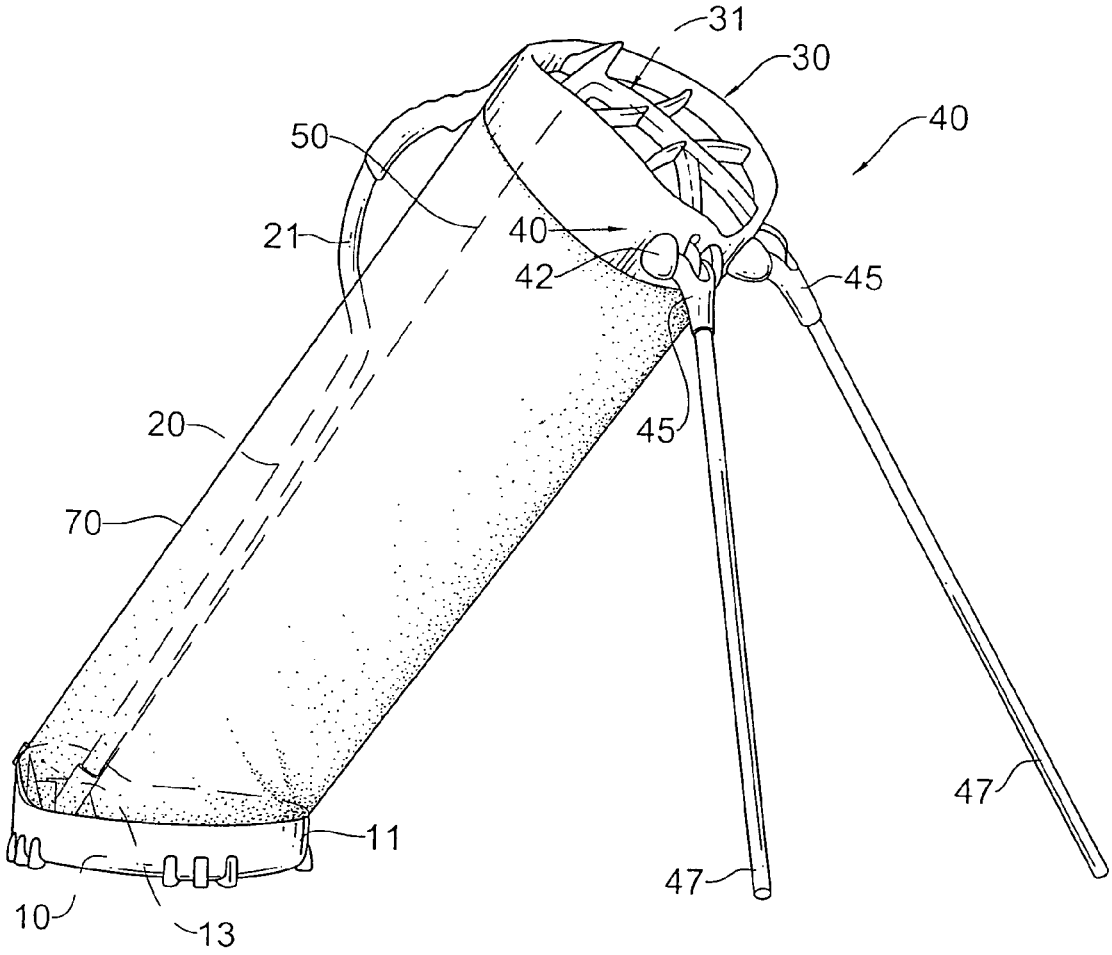
FIG. 2 is an operational perspective view of the golf bag structure in FIG. 1 with the legs of the leg assemblies extended.
Figure 5:
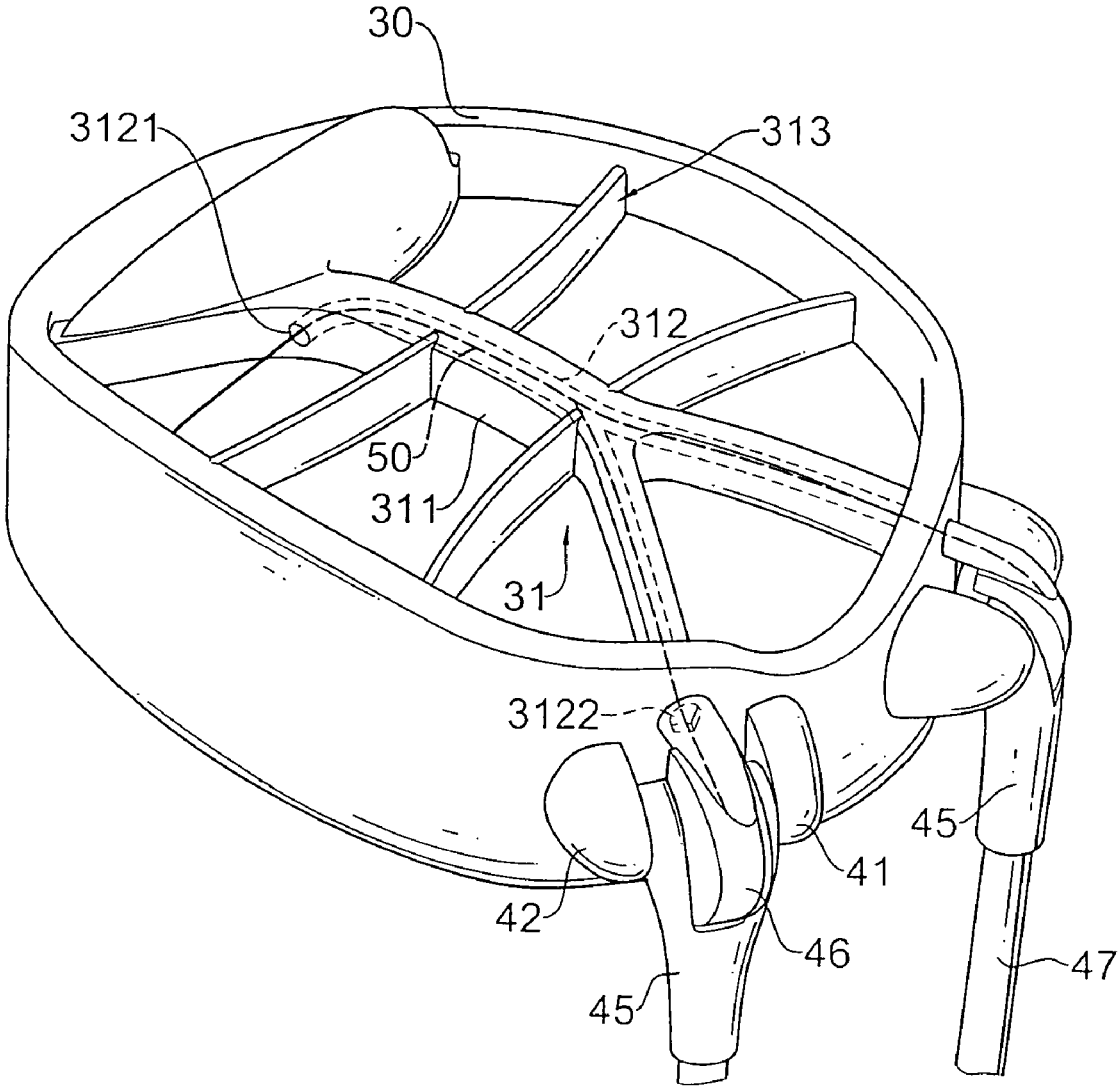
FIG. 5 is an enlarged perspective view of the top frame, leg assemblies and cord of the golf bag structure in FIG. 1.

With further reference to FIGS. 2 and 5, the top frame (30) is mounted on the top end of the post (20) and has a central opening, an outer surface, an inner surface and a divider (31). The central opening has a front and a rear. The divider (31) is attached to the inner surface of the top frame (30) across the central opening, divides the central opening into at least two smaller openings, may be Y-shaped, has a longitudinal divider (311), a cord passage (312) and multiple transverse dividers (313). The longitudinal divider (311) is formed from the front of the central opening to the rear of the central opening, divides the central opening of the top frame (30) to two sub openings and may be Y-shaped. The cord passage (312) is formed longitudinally through the longitudinal divider (311) and has a rear opening (3121) and two front openings (3122) opposite to the rear opening (3121). The rear opening (3121) is close to the post (20). The front openings (3122) are opposite to the rear opening (3121). The transverse dividers (313) are formed between the longitudinal divider (311) and the inner surface of the top frame (30) to further divide the sub openings to smaller openings.

Figure 6:
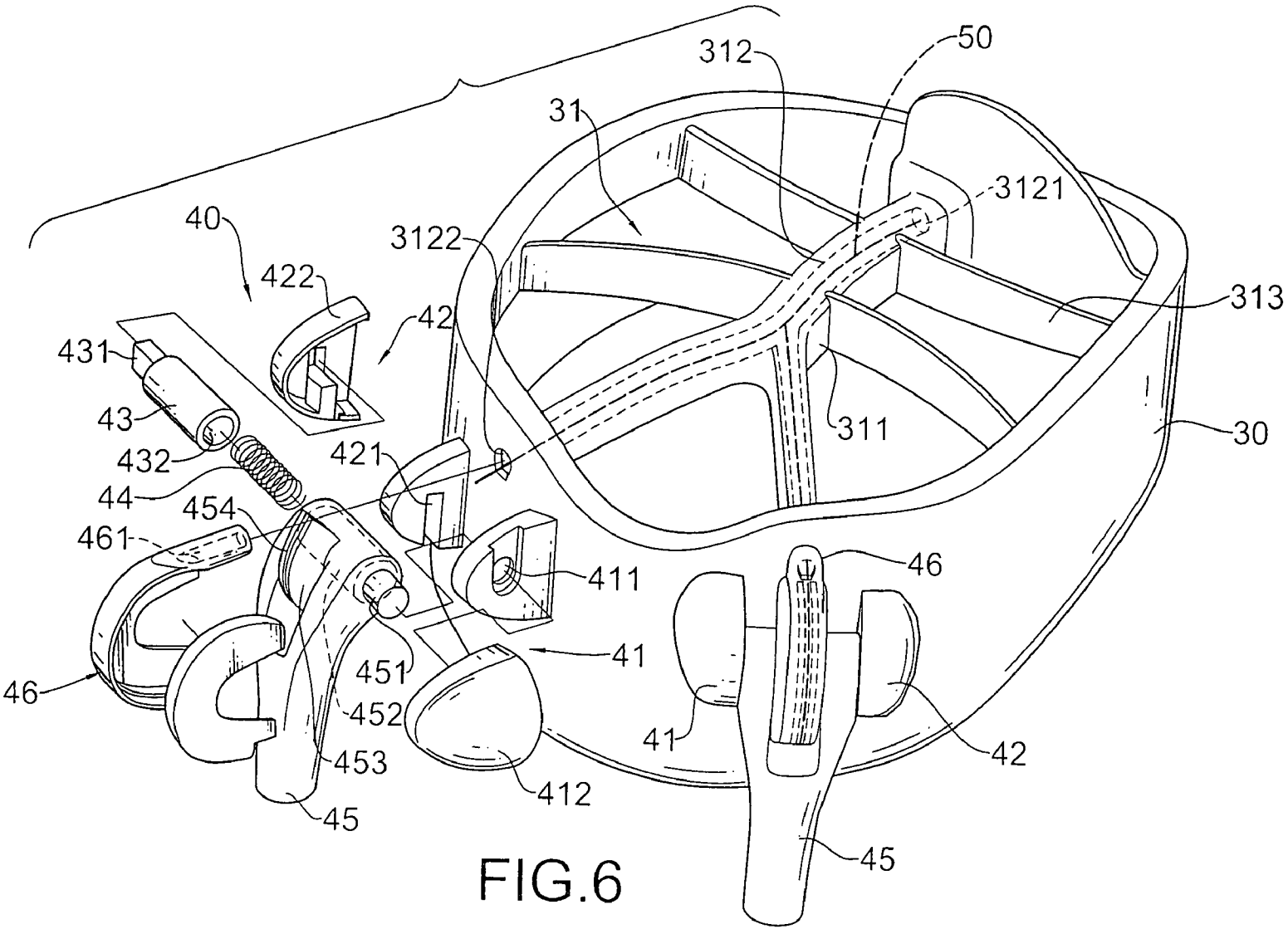
FIG. 6 is a partially exploded perspective view of the top frame, leg assemblies and cord of the golf bag structure in FIG. 5.

With further reference to FIG. 6, the leg assemblies (40) are attached to the top frame (30) and correspond respectively to the front openings (3122). Each leg assembly (40) has a bracket assembly, a pivot mount (45), a torsion spring (44), a cord cover (46) and a leg (47).

The bracket assembly is attached to the top frame (30) and may have an inside bracket (41), an outside bracket (42) and a pivot pin (43). The inside bracket (41) is attached to and protrudes out from the outer surface of the top frame (30), may comprise a body and a cup (412) and has a pivot hole (411) defined in the inside bracket (41). The body is formed on the outer surface of the top frame (30). The cup (412) is mounted to the body to form the inside bracket (41). The outside bracket (42) is attached to and protrudes out from the outer surface of the top frame (30) parallel to the inside bracket (41), may comprise a body and a cup (422) and has a mounting slot (421). The body is formed on outer surface of the top frame (30). The cup (422) is mounted on the body to form the outside bracket (422) The mounting slot (421) is defined through the outside bracket (42) and is aligned with the pivot hole (411) in the inside bracket (41). The pivot pin (43) is mounted between the inside bracket (41) and the outside bracket (42) and has an outer end, an inner end, a mounting protrusion (431) and a spring hole (432). The mounting protrusion (431) is formed coaxially on and protrudes longitudinally from the outer end of the pivot pin (43) and is mounted in the mounting slot (421) in the outside bracket (42) to fasten the pivot pin (43) to the outside bracket (42). The spring hole (432) is defined in the inner end of the pivot pin (43).

The pivot mount (45) is attached pivotally to the bracket assembly and may be mounted pivotally on the pivot pin (43) between the inside bracket (41) and the outside bracket (42) of the corresponding bracket assembly and has two sides, a protruding pivot pin (451), a mounting hole (452) and a cord mount (453). The protruding pivot pin (451) is formed on one side of the pivot mount (45) and is mounted rotatably in the pivot hole (411) in the inside bracket (41) of the corresponding bracket assembly. The mounting hole (452) is defined coaxially with the protruding pivot pin (451) in the other side, rotatably holds the pivot pin (43) of the corresponding bracket assembly so the pivot mount (45) pivots between the inside bracket (41) and the outside bracket (42). The cord mount (453) is formed on the pivot mount (45) and has a part-circular groove (454) defined in the cord mount (453) and aligning with the corresponding front opening (3122) of the cord passage (312) in the top frame (30).

The torsion spring (44) is mounted in the spring hole (432) in the pivot pin (43), biases the pivot mount (45) to locate alongside the outer surface of the top frame (30) and has two ends securely mounted to the pivot pin (43) and the pivot mount (45). The torsion spring (44) keeps pivot mount (45) from pivoting inadvertently when no external force is applied to the pivot mount (45). Assembly of the inside bracket (41), outside bracket (42), pivot pin (43), pivot mount (45) and torsion spring (44) requires no tools.

The cord cover (46) covers the cord mount (453) and has a tube and a shell. The tube is attached coaxially to the corresponding front opening (3122) of the cord passage (312) in the top frame (30) and has a cord hole (461) defined through the tube and communicating with the front openings (3122) and the part-circular groove (454). The shell is formed on the tube and covers the cord mount (453) having the part-circular groove (454).

The leg (47) is attached to the pivot mount (45).

The cord (50) may be a fiber cord or a metal cable, is lightweight, may be Y-shaped, extends through the through hole (135) in the cord guide (133) and the cord passage (312) in the divider (31) of the top frame (30) and is connected to the inner surface of the sidewall (11) on the base (10) and pivot mounts (45) of the leg assemblies (40). The cord (50) has a bottom end and two top ends. The bottom end is attached to the inner surface of the sidewall (11). The top ends are attached respectively to and pivot the pivot mounts (45), may extend respectively through the front openings of the cord passage (312) and the cord holes (461) in the tubes of the cord covers (46) and may be mounted respectively in the part-circular grooves (454) in the cord mounts (453) on the pivot mounts (45).

An operation to stand the golf bag is simple and has only one step, which is inclining the golf bag on the ground. Inclining the golf bag pivots the post (20) down relative to the base (10). The inclined post (20) causes the cord (50) to pull and pivot the pivot mounts (45) so that the legs (47) on the pivot mounts (45) rotate out and contact the ground to securely stand the golf bag.

The golf bag with the leg assemblies (40) keeps articles such as golf clubs in the golf bag from spilling out. Furthermore, the lightweight cord (50) concealed in the cord passage (312) and the tubes and covered by the shells of the cord covers (46) makes the golf bag compact, light and hardly break. Moreover, one-step operation of standing the golf bag is simple, convenient, effort-saving and time-saving.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A golf bag structure comprising:

a base having a pivot bracket mounted pivotally on the base and having a cord guide formed on the pivot bracket and having a through hole defined through the cord guide;

a post attached to and extending up from the pivot bracket and having a top end and a bottom end;

a top frame mounted on the top end of the post and having a central opening and a cord passage formed through the top frame;

two leg assemblies attached to the top frame and corresponding respectively to the front openings, and each leg assembly having a bracket assembly attached to the frame, a pivot mount attached pivotally to the bracket assembly and a leg attached to the pivot mount; and a cord extending through the through hole in the cord guide and the cord passage in the top frame and connected to the base and the pivot mounts of the leg assemblies.

2. The golf bag structure as claimed in claim 1, wherein:

the base having a top surface and an annular sidewall extending up from the base and having an inner surface;

the pivot bracket is mounted pivotally on the top surface of the base, is adjacent to the sidewall and further has a distal end and a mounting hole defined in the distal end;

the bottom end of the post is mounted in the mounting hole in the distal end of the pivot bracket;

the top frame having a front and a rear, an outer surface, an inner surface; and a divider attached to the inner surface of the top frame across the central opening, dividing the central opening into at least two sub openings;

the cord passage is formed through the divider and having a rear opening close to the post and two front openings opposite to the rear opening; and the cord having a bottom end attached to the inner surface of the sidewall and two top ends attached respectively to and pivoting the pivot mounts.

3. The golf bag structure as claimed in claim 2, wherein:

the bracket assembly of each leg assembly has an inside bracket attached to and protruding out from the outer surface of the top frame and having a pivot hole defined in the inside bracket;

an outside bracket attached to and protruding out from the outer surface of the top frame parallel to the inside bracket and having a mounting slot defined through the outside bracket and aligned with the pivot hole in the inside bracket; and a pivot pin mounted between the inside bracket and the outside bracket and having an outer end, an inner end, a mounting protrusion formed coaxially on and protruding longitudinally from the outer end of the pivot pin and mounted in the mounting slot in the outside bracket and a spring hole defined in the inner end of the pivot pin;

the pivot mount of each leg assembly is mounted pivotally on the pivot pin between the inside bracket and the outside bracket of a corresponding bracket assembly and further has two sides, a protruding pivot pin formed on one side of the pivot mount and mounted rotatably in the pivot hole in the inside bracket of the corresponding bracket assembly and a mounting hole defined coaxially with the protruding pivot pin in the other side of the pivot mount and rotatably holding the pivot pin of the corresponding bracket assembly; and each leg assembly further has a torsion spring mounted in the spring hole in a corresponding pivot pin, biasing a pivot mount to locate alongside the top frame and having two ends securely mounted respectively to the corresponding pivot pin and the corresponding pivot mount.

4. The golf bag structure as claimed in claim 3, wherein:

the pivot mount of each leg assembly further has a cord mount formed on the pivot mount and having a part-circular groove defined in the cord mount and aligning with a corresponding front opening of the cord passage in the top frame;

each leg assembly further has a cord cover covering a corresponding cord mount and having a tube attached coaxially to a corresponding front opening of the cord passage in the top frame and having a cord hole defined through the tube and communicating with the corresponding front opening and the part-circular groove in the corresponding cord mount; and a shell formed on the tube and covering the part-circular groove in the corresponding cord mount; and top ends of the cord extend respectively through the front openings of the cord passage and the cord holes in the tubes of the cord covers and are mounted respectively in the part-circular grooves in the cord mounts on the pivot mounts.

5. The golf bag structure as claimed in claim 4, wherein the divider further has a longitudinal divider formed from the front to the rear of the central opening of the top frame and dividing the central opening to two sub openings, and multiple transverse dividers formed between the longitudinal divider and the inner surface of the top frame and dividing the sub openings to multiple smaller openings.

6. The golf bag structure as claimed in claim 5, wherein the post further has a curved handle being a section of the post near the top end.

7. The golf bag structure as claimed in claim 6, wherein the cord is a fiber cord.

8. The golf bag structure as claimed in claim 6, wherein the cord is a metal cable.

9. The golf bag structure as claimed in claim 6, wherein the divider is Y-shaped.

10. The golf bag structure as claimed in claim 9, wherein the cord is Y-shaped.

* * * * *